United States Patent [19]

Moxley

[11] Patent Number: 5,064,061

[45] Date of Patent: Nov. 12, 1991

[54] HOOK ASSEMBLY FOR PORTABLE CONTAINERS

[75] Inventor: H. Edward Moxley, West Hills, Calif.

[73] Assignee: Ultrahook, Inc., Laguna Beach, Calif.

[21] Appl. No.: 534,249

[22] Filed: Jun. 7, 1990

[51] Int. Cl.[5] ..... A45C 5/12; A45C 13/00; B65D 85/18

[52] U.S. Cl. ..... 206/289; 383/23; 248/95

[58] Field of Search ..... 206/284–292, 206/279; 383/23; 248/95, 214, 215, 390; 190/101, 102; 211/113, 115; 223/85, 29

[56] References Cited

U.S. PATENT DOCUMENTS

| | | | |
|---|---|---|---|
| 746,617 | 12/1903 | Wenzell | 190/102 |
| 2,705,180 | 3/1955 | Enrich | 383/23 X |
| 2,849,093 | 8/1958 | Chesnut | 206/292 |
| 3,035,673 | 5/1962 | Schenkler | 206/289 |
| 3,123,331 | 3/1964 | Field et al. | 248/317 |
| 3,179,363 | 4/1965 | Sheiman | 248/95 |
| 3,201,077 | 8/1965 | Heimann | 248/340 |
| 3,221,848 | 12/1965 | O'Neil | 206/289 |
| 3,388,882 | 6/1968 | Burroughs et al. | 248/97 |
| 3,469,287 | 9/1969 | Hamline | 24/73 |
| 3,512,621 | 5/1970 | Teetor | 206/287 |
| 3,612,232 | 10/1971 | Larson | 206/287 |
| 3,814,359 | 6/1974 | Powell | 248/99 |
| 3,817,435 | 6/1974 | DeLuca et al. | 224/45 |
| 3,831,740 | 8/1974 | Pendergast et al. | 206/7 K |
| 3,927,741 | 12/1975 | Rubinstein | 190/101 |
| 4,091,976 | 5/1978 | Morse | 206/279 X |
| 4,523,357 | 6/1985 | Widditsch | 24/230.5 R |
| 4,542,824 | 9/1985 | Allen | 206/287.1 |
| 4,553,294 | 11/1985 | Larsen et al. | 24/489 |
| 4,887,700 | 12/1987 | Rice | 206/287.1 X |

FOREIGN PATENT DOCUMENTS

| | | | |
|---|---|---|---|
| 606521 | 12/1934 | Fed. Rep. of Germany | 383/23 |
| 675746 | 5/1939 | Fed. Rep. of Germany | 206/289 |

*Primary Examiner*—Sue A. Weaver

*Attorney, Agent, or Firm*—Hawes & Fischer

[57] ABSTRACT

The retractable hook assembly, preferably for an article of luggage, includes a rigid shaft received within a cylindrical member, the shaft being movable between extended and retracted positions. A washer with a projecting stud is fixed to the inner end of the shaft. A slot in the cylindrical member receives the stud to, in one rotational orientation, hold the shaft and its hook extended, and when released from the slot, to cam the shaft into a second rotational orientation as the shaft is driven by a spring into the cylindrical member, thereby to provide a self aligning and self retracting hook assembly.

17 Claims, 1 Drawing Sheet

HOOK ASSEMBLY FOR PORTABLE CONTAINERS

FIELD OF THE INVENTION

The present invention relates to a hook assembly, particularly a self aligning and self retracting hook assembly for portable containers such as luggage.

BACKGROUND OF THE INVENTION

Luggage today often is in the form of a garment bag, the bag containing clothes on hangers and being foldable for carrying but unfoldable to hang on a rod. Typically, such luggage includes a flexible hook assembly, the hook being mounted on a chain which in turn is attached to internal structure within the luggage for supporting the clothes on hangers and which, in some cases, also shapes the end of the bag.

Flexible hook assemblies of this sort cause many problems. First, some way must be found to attach them to the luggage when they are not in use. Such attachment often proves unsatisfactory, or for one reason or another is not used, thereby allowing the hook to damage and catch on other luggage, on baggage conveyors and other things. (This is a major cause of damage to both luggage and conveyors. See for example "Trauma of Lost Luggage," USA Today, Feb. 16–18, 1990, page 1) Second, because the hook attachment is flexible, the hook must be held as it is being placed on a rod; this requires both hands to hang the garment bag, one holding the bag and other the luggage. Thus, to hang the bag a person must put down everything else that they may have been carrying, detach the hook from the bag and then use both hands to hang it on a rod. Similarly, to detach the hook and bag from a rod it is necessary to again use both hands, requiring the person who wishes to detach the bag to put down anything else they may be carrying. Also, such hook constructions do not permit the hook to be used for anything else; the hook for example when stowed cannot be used to carry the bag.

For these and other reasons there has long existed the need for a suitable hook assembly for portable containers such as luggage that can be easily and conveniently stored then positioned for use, and which operation may be effected if desired with one hand. These and other objects of the present invention will be apparent from the following description of a preferred embodiment.

BRIEF DESCRIPTION OF THE INVENTION

The hook assembly of the present invention includes a hook element having an elongated shaft, and a cylindrical member which receives the shaft of the hook. Spring means are provided within the cylindrical member to urge the shaft of the hook towards a retracted position within the cylindrical member. Catch means are provided to hold the shaft of the hook in an extended position. Preferably, in moving between the retracted and extended positions, the hook moves between a first and a second rotational orientation relative to the cylindrical member. Thus, in a presently preferred embodiment the shaft of the hook may include a projecting stud that is received in a slot provided in the cylindrical member. The slot is shaped, and the stud oriented, such that the shaft is in the first rotational position while the hook is in its extended position. The slot also provides a sloping shoulder to cam the stud and the shaft to which it is attached from its first rotational orientation to its second rotational orientation as the spring means forces the shaft into the cylindrical member. The cylindrical member may include means, such as projecting tabs, to attach the hook assembly to a rigid luggage element.

BRIEF DESCRIPTION OF THE DRAWINGS

The invention will be further described in connection with the accompanying drawings in which.

DETAILED DESCRIPTION

Figure 1:
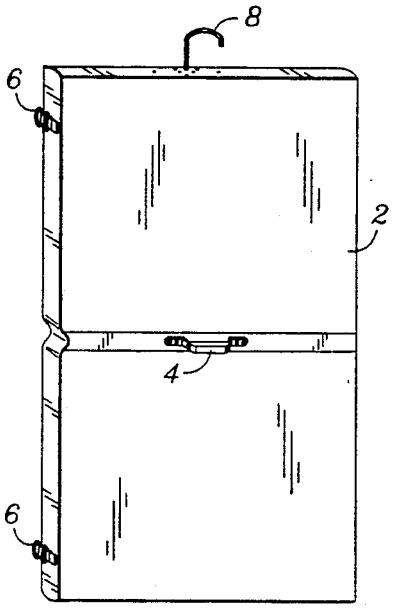
FIG. 1 is a perspective view of a garment bag incorporating the hook assembly of the present invention.

In its presently preferred form, the hook assembly of the present invention is designed to be incorporated into luggage shaped as a garment bag, to permit the bag when unfolded to be easily hung on a rod or door. Such a garment bag is shown in FIG. 1. The bag 2 includes an intermediate handle 4 by which the bag may be carried when in its folded position, the bag generally being folded in half such that the handle lies at the fold. Typically, locking clips 6 are provided on the bag to hold it in its folded position.

The bag includes a projecting hook 8 which, when in its extended position as shown in FIG. 1, permits the unfolded bag to be hung on a rod.

Figure 2:
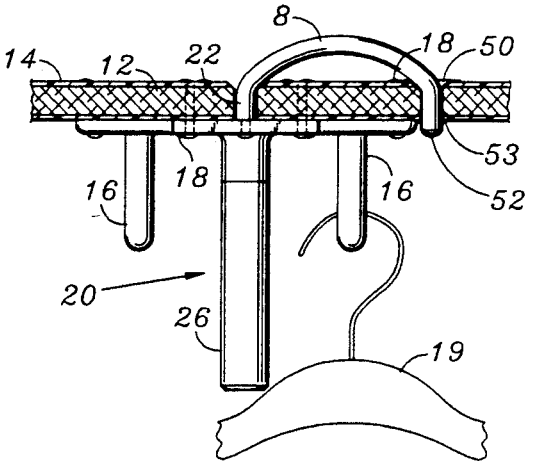
FIG. 2 is a view of a portion of the garment bag, with the hook assembly, shown in FIG. 1.
Figure 5:
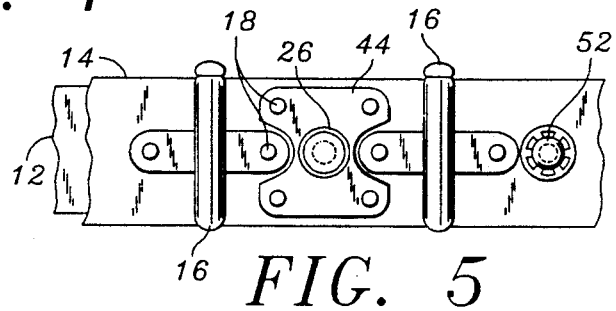
FIG. 5 is a bottom view of the hook assembly shown in FIG. 2.

As shown in FIG. 2, such hanging bags are often constructed with a rigid top bar member 12 incorporated within a pocket provided in the fabric enclosure 14 that defines the bag. This rigid top bar extends completely across the top of the bag to hold the end of the bag in the shape shown in FIG. 1. As is typical in such garment bag constructions, one or more brackets 16 may be attached to this end of the bag, and to its rigid member, by rivets 18 or other suitable means, these brackets receiving the hooks of hangers 19 used to hang clothes within the bag. Today a common form of such bracket is a "Wally clamp" which is a universal clamp that supports all types of hangers.

Preferably, at the center of the bag is provided a hook assembly 20 that includes a rigid shaft 22, the end portion of which is turned to form hook 8. This shaft 22 in turn is received within a cylindrical member 24 that preferably is surrounded by a sleeve 26 to give a finished appearance to the interior portion of the hook assembly, and to shield clothing within the bag from the movable internal elements of the hook assembly. A V-shaped opening 30 in the cylindrical member provides a sloped shoulder 32 and opposed notches 34.

Figure 4:
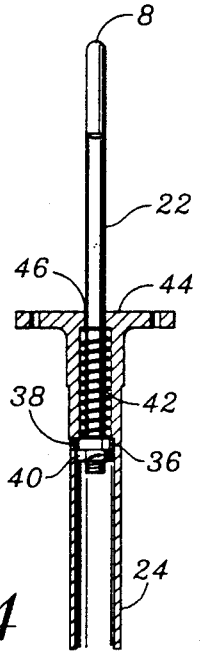
FIG. 4 is a vertical cross-sectional view of the hook assembly shown in FIG. 3.

The internal end portion of rigid shaft 22 receives a washer or disk 36 (see FIG. 4) that includes a projecting stud 38. This stud is received within opening 30 of the cylindrical member. A clip or other suitable element 40 prevents the washer from passing beyond the end of shaft 22. The washer and the end portion of the shaft are shaped, or the washer is otherwise fixed to the shaft, to hold the washer and shaft in a given rotational position relative to one another.

A spring 42 is received within the cylindrical member. The lower end of the spring bears on the upper surface of washer 36. The upper end of the spring bears on a plate 44 that is attached to the upper end of the cylindrical member by suitable means, this plate including a central opening 46 through which shaft 22 projects. Thus, the spring is captured between the plate and the washer, and urges the washer away from the plate, thereby tending to force shaft 22 and its hook towards a retracted position within the cylindrical member 24.

Figure 3:
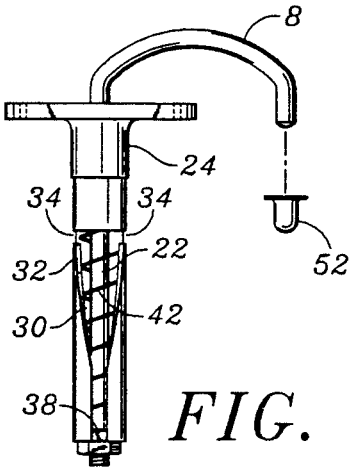
FIG. 3 is an elevational view of the hook assembly.

When completely seated within the cylindrical member, as shown in FIGS. 2 and 3, hook portion 8 of the rigid shaft 22 is in a first rotational position or orientation relative to the cylindrical member, while when the hook has been pulled out the cylindrical member to its extended position such that stud 38 is received in one of notches 34, the hook and shaft are held in a second rotational position or orientation (shown in FIG. 4) preferably at approximately a right angle to the first position. Because of the V-shaped opening 30 and its two opposed notches 34, this second position may orient the hook to fall either toward or away from the side of the bag with handle 4. When in either of the second positions, such that stud 38 is received in one of notches 34, the rigid hook member will be held against the spring such that it projects well beyond the cylindrical member as shown in FIG. 1 for example. In this position, sufficient clearance is provided between the end of the hook and the bag to permit the hook to be easily passed over a rod or over the top of the door to support the bag. However, when the hook and shaft is rotated slightly such that stud 38 is disengaged from notch 34, spring 42 then is free to force the hook and its shaft into cylindrical member 24. As this happens, the side of the stud is cammed by the sloping shoulder 32 of the opening in the cylindrical member to automatically turn the hook and its shaft from the second rotational orientation to the first rotational orientation. Thus, the hook assembly provides a hook that is both self retracting and self aligning (or self orienting).

Preferably the hook assembly and its fabric envelope includes an opening 50 which receives a cup 52 that is held in this opening by a clip or retaining ring 53. This cup receives the end portion of hook 8 when the hook and its rigid shaft are fully seated within the cylindrical member 24 as shown in FIG. 2. Thus, in this retracted position, the hook exposes only a small arc or loop beyond the end of the bag. Since the hook is urged into this position, and held in this position, by the spring received within the cylindrical member, it is easily stored, tends to stay retracted, and will not expose its outer end to catch on other bags, luggage conveyors or the like.

While a presently preferred embodiment of the invention has been described, variations in the construction of the hook assembly will be apparent to those skilled in this art. Accordingly, the scope of the invention is not limited to the presently preferred embodiment, but rather is set forth in the following claims.

I claim:

1. A garment bag including an enclosure for receiving garments, means to hold the garment within the enclosure, a hook element having an elongated shaft, a cylindrical member dimensioned to receive the shaft of the hook, permitting the shaft to be moved within the cylindrical member such that the hook travels between a retracted position and an extended position relative to the cylindrical member, a spring means within the cylindrical member urging the shaft down into the cylindrical member and the hook into its retracted position, and means to automatically orient the hook as it retracts to thereby position the hook in a predetermined alignment with the enclosure.

2. A garment bag as set forth in claim 1 in which the means to retract the hook includes shield means to receive the end of the hook to the shield it from inadvertent engagement with other articles while the hook is in its retracted position.

3. A garment bag as set forth in claim 2 in which the means to automatically orient the hook as it retracts positions the end of the hook to be received within said shield means.

4. A garment bag as set forth in claim 3 including engagement means to hold the hook in an extended position to permit the hook to be easily passed over a rod or other supporting member.

5. A retractable hook assembly comprising a hook element having an elongated shaft, a cylindrical member dimensioned to receive the shaft of the hook, permitting the shaft to be moved within the cylindrical member such that the hook travels between a retracted position and an extended position relative to the cylindrical member, spring means within the cylindrical member urging the shaft down into the cylindrical member and the hook into its retracted position, and orientation means to position the hook in a predetermined alignment with the cylindrical member as it moves to its retracted position.

6. A retractable hook assembly as set forth in claim 5 wherein said orientation means includes a swivel means to permit the hook to rotate relative to the cylindrical member.

7. A retractable hook assembly as set forth in claim 5 including catch means to hold the shaft in an extended position relative to the cylindrical member, the shaft in the extended position being at a different alignment relative to the cylindrical member than when in its retracted position.

8. A retractable hook assembly as set forth in claim 7 in which the hook is movable between a first rotational orientation relative to the cylindrical member when retracted and a second rotational orientation relative to the cylindrical member when extended, the catch means holding the hook in said second orientation.

9. A retractable hook assembly as set forth in claim 8 wherein said orientation means includes a cam means to rotate the shaft to said first orientation when said shaft moves to the retracted position, thereby causing it to move into said predetermined alignment.

10. A retractable hook assembly as set forth in claim 9 including a washer, means fixing the washer to the end of the shaft received within the cylindrical member, the washer including a projecting stud, said cam means including a slot within the cylindrical member receiving said stud, the slot being shaped to cam the shaft to said first orientation as said shaft moves from the extended to the retracted position, said spring means bearing on said washer, said slot also including a notch comprising said catch means, the notch receiving said stud and holding said shaft in said second orientation while the hook is in its extended position.

11. An article of luggage incorporating a transverse rigid member at one end, said article including a retractable hook assembly comprising a hook with an elongated shaft, a cylindrical member dimensioned to receive the shaft of the hook, permitting the shaft to be moved within the cylindrical member such that the hook travels between a retracted position and an extended position relative to the cylindrical member, spring means within the cylindrical member urging the shaft down into the cylindrical member and the hook into its retracted position, catch means to hold the shaft in an extended position relative to the cylindrical member, orientation means to position the hook in a predetermined alignment with the cylindrical member as it moves to its retracted position, and means attaching the cylindrical member to the transverse rigid member.

12. An article of luggage including a hook assembly as set forth in claim 11 wherein said hook is movable between a first rotational orientation relative to the cylindrical member when retracted and a second rotational orientation relative to the cylindrical member when extended, the catch means holding the hook in said second orientation, wherein said orientation means includes a cam means to rotate the shaft to said first orientation when said shaft moves to the retracted position thereby causing it to move into said predetermined alignment.

13. An article of luggage including a hook assembly as set forth in claim 12 wherein said hook assembly includes a washer, means fixing the washer to the end of the shaft received within the cylindrical member, the washer including a projecting stud, said cam means including a slot within the cylindrical member receiving said stud, the slot being shaped to cam the shaft to said first orientation as said shaft moves from the extended to the retracted position, said spring means bearing on said washer said slot also including a notch comprising said catch means, the notch receiving said stud and holding said shaft in said second orientation while the hook is in its extended position.

14. An article of luggage as set forth in claim 13 wherein said orientation means includes a swivel means to permit the hook to rotate relative to the cylindrical member and to the transverse rigid member.

15. An article of luggage including a hook assembly as set forth in claim 14 including shield means to receive the end portion of hook when the hook is in its retracted position, thereby to prevent the hook from catching or snagging other articles.

16. An article of luggage including a hook assembly as set forth in claim 15 in which the hook, transverse rigid member and shield means are shaped and cooperate to expose a portion of the hook, when in its retracted position, to permit it to be grasped and pulled from its retracted position towards its extended position.

17. An article of luggage including a hook assembly as set forth in claim 11 wherein said hook is movable between a first rotational orientation relative to the cylindrical member when retracted and either a second or third rotational orientation relative to the cylindrical member when extended, the second and third rotational orientations being substantially opposite to one another and positioning the hook to extend generally perpendicular to the transverse rigid member, wherein said catch means holding the hook in either said second or third rotational orientations, and wherein said orientation means includes a cam means to rotate the shaft to said first rotational orientation when said shaft moves from either the second or third rotational orientation towards the retracted position thereby causing it to move into said predetermined alignment.

* * * * *